US011262146B2

(12) United States Patent
Hong

(10) Patent No.: US 11,262,146 B2
(45) Date of Patent: Mar. 1, 2022

(54) SOOT BLOWER AND METHOD OF CLEANING TUBULAR HEAT EXCHANGER BY USING THE SAME

(71) Applicant: GEESCO CO., LTD., Yong-si (KR)

(72) Inventor: Sung-Ho Hong, Seoul (KR)

(73) Assignee: GEESCO CO., LTD., Yong-si (KR)

( * ) Notice: Subject to any disclaimer, the term of this patent is extended or adjusted under 35 U.S.C. 154(b) by 377 days.

(21) Appl. No.: 16/340,679

(22) PCT Filed: Oct. 25, 2016

(86) PCT No.: PCT/KR2016/012013

§ 371 (c)(1),
(2) Date: Apr. 9, 2019

(87) PCT Pub. No.: WO2018/074644

PCT Pub. Date: Apr. 26, 2018

(65) Prior Publication Data

US 2019/0293372 A1 Sep. 26, 2019

(30) Foreign Application Priority Data

Oct. 18, 2016 (KR) ..... 10-2016-0135297

(51) Int. Cl.
*F28G 15/00* (2006.01)
*B08B 3/02* (2006.01)
(Continued)

(52) U.S. Cl.
CPC ..... *F28G 15/003* (2013.01); *B08B 3/022* (2013.01); *B08B 7/0021* (2013.01); *F28G 1/12* (2013.01); *F28G 1/166* (2013.01); *F28G 15/04* (2013.01)

(58) Field of Classification Search
CPC ..... F28G 15/003; F28G 1/12; F28G 1/166; F28G 15/04; B08B 3/022; B08B 7/0021
(Continued)

(56) References Cited

U.S. PATENT DOCUMENTS 4,207,648 A * 6/1980 Sullivan ..... F28G 15/04 15/316.1
4,248,180 A * 2/1981 Sullivan ..... F23J 3/00 122/390
(Continued)

FOREIGN PATENT DOCUMENTS

CN 102814309 A 12/2012
CN 105765336 A 7/2016
(Continued)

OTHER PUBLICATIONS

Notice of Allowance for an Invention Patent, Chinese Application No. 201680090175.3, dated Feb. 4, 2021.
(Continued)

*Primary Examiner* — Jon T. Schermerhorn, Jr.
(74) *Attorney, Agent, or Firm* — Crowe & Dunlevy, P.C.

(57) ABSTRACT

The present disclosure relates to a soot blower including: a lance tube which includes one end that reciprocally moves in one direction on a surface of an inlet port of a flow path of the tubular heat exchanger; a drive unit which is connected to the lance tube and reciprocally moves and rotates the lance tube in the one direction; a first nozzle which is connected to the one end of the lance tube and discharges steam to the inlet port; and a second nozzle which is disposed adjacent to the first nozzle and connected to the one end of the lance tube and discharges solid particles to the inlet port, and the present disclosure relates to a method of cleaning a tubular heat exchanger by using the soot blower.

10 Claims, 10 Drawing Sheets

(51) Int. Cl.

| | |
|---|---|
| ***B08B 7/00*** | (2006.01) |
| ***F28G 1/12*** | (2006.01) |
| ***F28G 1/16*** | (2006.01) |
| ***F28G 15/04*** | (2006.01) |

(58) Field of Classification Search
USPC ..... 165/95
See application file for complete search history.

(56) References Cited

U.S. PATENT DOCUMENTS

| | | | | |
|---|---|---|---|---|
| 4,257,359 | A * | 3/1981 | Capobianco | F28G 3/166 122/390 |
| 4,567,622 | A * | 2/1986 | Ziels | F28G 3/166 15/316.1 |
| 4,649,987 | A * | 3/1987 | Frauenfeld | F28G 9/005 165/5 |
| 6,065,528 | A | 5/2000 | Fierle et al. | |
| 8,814,432 | B2 * | 8/2014 | Thoma | F16J 15/30 384/16 |
| 2004/0006841 | A1 * | 1/2004 | Jameel | F28G 15/003 15/318.1 |
| 2013/0334343 | A1 * | 12/2013 | Bunker | B05B 7/1486 239/424 |
| 2017/0016686 | A1 * | 1/2017 | Kim | F28G 1/12 |

FOREIGN PATENT DOCUMENTS

| | | | |
|---|---|---|---|
| DE | 60314147 | T2 | 7/2007 |
| JP | 59170735 | U | 11/1984 |
| JP | 01234711 | A | 9/1989 |
| JP | 0533920 | A | 2/1993 |
| JP | 05-052592 | U | 7/1993 |
| JP | 0820068 | B2 | 3/1996 |
| JP | 08178588 | A | 7/1996 |
| JP | 2571995 | B2 | 1/1997 |
| JP | 09-089497 | A | 4/1997 |
| JP | 3111190 | B2 | 11/2000 |
| JP | 2003506664 | A | 2/2003 |
| JP | 3823215 | B2 | 9/2006 |
| JP | 4204309 | B2 | 1/2009 |
| JP | 2010-249363 | A | 11/2010 |
| JP | 4906352 | B2 | 3/2012 |
| JP | 2012057913 | A | 3/2012 |
| JP | 2016540953 | A | 12/2016 |
| KR | 840000449 | B1 | 4/1984 |
| KR | 10-2002-0027488 | A | 4/2002 |
| KR | 101387024 | B1 | 4/2014 |
| KR | 20150010199 | A | 1/2015 |
| KR | 101545439 | B1 | 8/2015 |
| WO | 9009850 | A1 | 9/1990 |
| WO | 2009139714 | A1 | 11/2009 |
| WO | 2012131552 | A1 | 10/2012 |
| WO | 2014142736 | A1 | 9/2014 |
| WO | 2015076472 | A1 | 5/2015 |
| WO | 2016014923 | A1 | 1/2016 |
| WO | 2016065256 | A2 | 4/2016 |
| WO | 2019063813 | A1 | 4/2019 |

OTHER PUBLICATIONS

European Search Repod (EESR) dated Apr. 23, 2020, of the corresponding European Patent Application No. 16919279.6.

PCT/KR2016/012013, International Search Report; dated Jul. 3, 2017 (only 2 pages listing references are translated).

* cited by examiner

SOOT BLOWER AND METHOD OF CLEANING TUBULAR HEAT EXCHANGER BY USING THE SAME

TECHNICAL FIELD

The present disclosure relates to a soot blower and a method of cleaning a tubular heat exchanger by using the same.

BACKGROUND ART

In general, in a combustion furnace, tubes and waste heat exchangers are repeatedly arranged in the form of a bundle of tubes. Dust or contaminants, which are produced during combustion and then accumulated on a heat exchanger tube, need to be periodically removed because the dust or contaminants cause deterioration in thermal efficiency. Recently, the contaminants are removed often by using compressed air or steam.

However, some of the contaminants cannot be sometimes removed well by the compressed air or the steam in these facilities. Further, steam cannot be used to remove contaminants existing on a tube in a waste heat boiler in a cement factory because the steam is likely to degrade cement quality. Meanwhile, steam cannot also be used for a biomass boiler tube because the steam increases corrosion of the tube caused by chlorine (CI).

DISCLOSURE

Technical Problem

The present disclosure has been made in an effort to provide a soot blower, which easily cleans a tubular heat exchanger, and a method of cleaning a tubular heat exchanger.

Technical problems to be solved by the present invention are not limited to the above-mentioned technical problems, and other technical problems, which are not mentioned above, may be clearly understood from the following descriptions by those skilled in the art to which the present invention pertains.

Technical Solution

An exemplary embodiment of the present invention provides a soot blower which includes a flow path through which a fluid passes and cleans a tubular heat exchanger positioned on the flow path, the soot blower including: a lance tube which includes one end that reciprocally moves in one direction on a surface of an inlet port of the flow path; a drive unit which is connected to the lance tube, reciprocally moves the lance tube in the one direction, and rotates the lance tube clockwise and counterclockwise; a first nozzle which is connected to the one end of the lance tube and discharges steam to the inlet port; and a second nozzle which is disposed adjacent to the first nozzle and connected to the one end of the lance tube and discharges solid particles to the inlet port.

The drive unit may include: a reciprocating drive unit which is connected to the lance tube and reciprocally moves the lance tube in the one direction; and a rotating drive unit which is connected to the lance tube and rotates the lance tube clockwise and counterclockwise.

The rotating drive unit may periodically change a rotation direction of the lance tube.

The rotating drive unit may rotate the lance tube clockwise or counterclockwise within a range of more than 0° to 180° or less.

The reciprocating drive unit may include: a sliding guide portion which is positioned on the lance tube; a sliding portion which reciprocally moves along the sliding guide portion; and a connecting portion which connects the sliding portion and the lance tube.

The soot blower may further include: a first tube which penetrates an interior of the lance tube and communicates with the first nozzle; and a second tube which penetrates an interior of the lance tube and communicates with the second nozzle.

The soot blower may further include: a steam supply unit which is connected to the first tube and supplies the steam to the first tube; and a solid particle supply unit which is connected to the second tube and supplies the solid particles to the second tube.

The solid particle supply unit may include multiple sub particle supply units, and the multiple sub particle supply units may supply different solid particles to the second tube.

The different solid particles may include at least one of dry ice pellets, ice pellets, and sand.

The second nozzle may be longer than the first nozzle.

The second nozzle may be different in shape from the first nozzle.

The soot blower may further include a nozzle protector which is disposed adjacent to the second nozzle, positioned at an outermost peripheral portion of the lance tube, and longer than the second nozzle.

The soot blower may further include a nozzle maintenance chamber which is disposed adjacent to the drive unit and surrounds the one end of the lance tube.

The nozzle maintenance chamber may include a gate through which the first nozzle and the second nozzle are exposed.

The first nozzle may be disposed to have an angle of more than 0° to 180° or less with respect to the second nozzle.

Another exemplary embodiment of the present invention provides a method of cleaning a tubular heat exchanger in which a fluid performs heat exchange on a flow path, the method including: discharging steam by a soot blower that reciprocally moves and rotates in one direction on a surface of an inlet port of the flow path; and discharging solid particles by the soot blower that reciprocally moves and rotates in the one direction on the surface of the inlet port.

The discharging of the steam may include discharging high-temperature steam, at a steam temperature of 90° C. to 300° C. and under a pressure of 10 $kg/cm^2$ g to 50 $kg/cm^2$ g, to the surface of the inlet port.

The discharging of the solid particles may include: discharging dry ice pellets, under a pressure of 0.5 $kg/cm^2$ g to 20 $kg/cm^2$ g, to the surface of the inlet port; and discharging ice pellets or sand, under a pressure of 0.5 $kg/cm^2$ g to 30 $kg/cm^2$ g, to the surface of the inlet port.

A movement speed of the soot blower, which reciprocally moves in the one direction on the surface of the inlet port, may vary.

The soot blower may rotate clockwise or counterclockwise about a rotation axis parallel to the one direction.

A rotation direction of the soot blower may be periodically changed.

Advantageous Effects

The present disclosure provides a soot blower, which easily cleans a tubular heat exchanger, and a method of cleaning a tubular heat exchanger.

MODE FOR INVENTION

Figure 1:
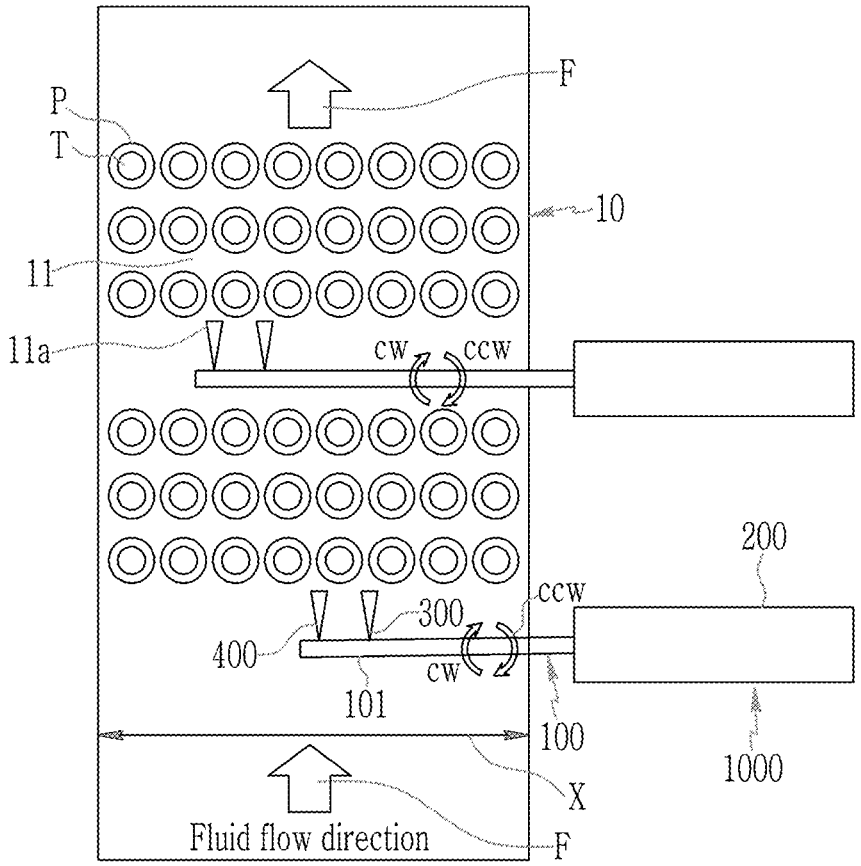
FIG. 1 is a view illustrating a soot blower for cleaning a tubular heat exchanger according to an exemplary embodiment.

Hereinafter, exemplary embodiments of the present invention will be described in detail with reference to the accompanying drawings. However, in the description of the present invention, a description of a function or configuration already publicly known will be omitted in order clarify the subject matter of the present invention.

A part irrelevant to the description will be omitted to clearly describe the present invention, and the same or similar constituent elements will be designated by the same reference numerals throughout the specification. In addition, a size and a thickness of each constituent element illustrated in the drawings are arbitrarily shown for convenience of description, but the present disclosure is not limited thereto.

In the drawings, the thickness of layers, films, panels, regions, etc., are exaggerated for clarity. In the drawings, the thicknesses of some layers and regions are exaggerated for convenience of description. It will be understood that when an element such as a layer, film, region, or substrate is referred to as being "on" another element, it can be directly on the other element or intervening elements may also be present.

Hereinafter, a soot blower according to an exemplary embodiment of the present invention will be described with reference to FIGS. 1 to 4.

FIG. 1 is a view illustrating the soot blower for cleaning a tubular heat exchanger according to the exemplary embodiment.

As illustrated in FIG. 1, a soot blower 1000 according to the exemplary embodiment cleans a tubular heat exchanger 10. The tubular heat exchanger 10 includes a flow path 11 through which a fluid F passes, and the tubular heat exchanger 10 serves to recover heat from the fluid F and supply the recovered heat to the outside. The flow path 11 of the tubular heat exchanger 10 includes an inlet port 11*a* into which the fluid F is introduced. Here, the tubular heat exchanger 10 may be, but not limited to, a superheater, a reheater, or a waste heat recovering heat exchanger of a boiler. The tubular heat exchanger 10 may have various shapes in the related art.

Figure 2:
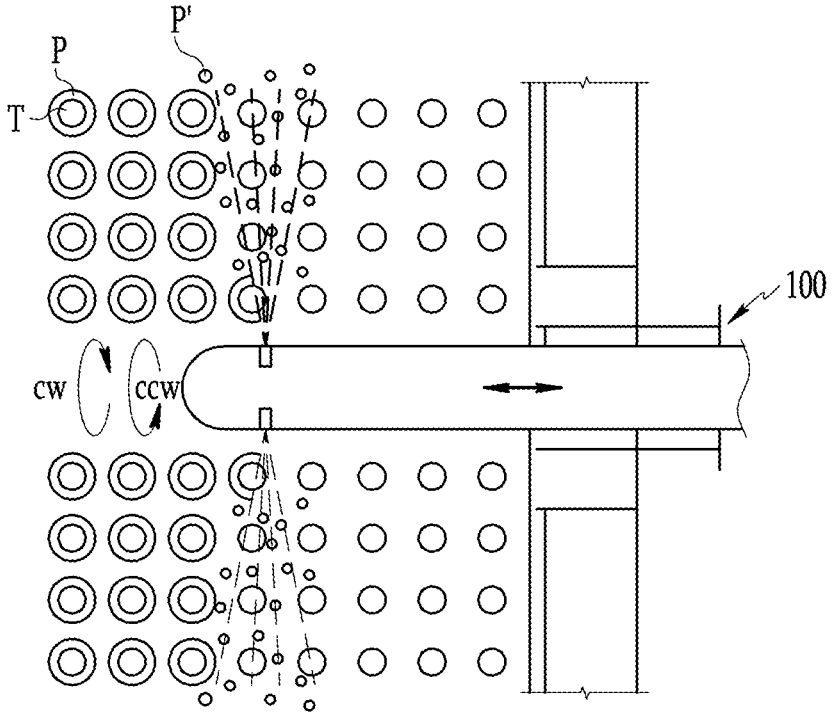
FIG. 2 is a view illustrating a principle in which the soot blower in FIG. 1 removes contaminants existing on the tubular heat exchanger.

FIG. 2 is a view illustrating a principle in which the soot blower in FIG. 1 removes contaminants P existing on the tubular heat exchanger 10. FIG. 2 schematically illustrates a state in which the contaminants P attached to surfaces of heat exchanger tubes T are removed by steam or solid particles discharged from the soot blower 1000 according to the present exemplary embodiment. In this case, the contaminants, which have been removed from the surfaces of the heat exchanger tubes T by the steam or the solid particles discharged from the soot blower 1000 according to the present exemplary embodiment, are denoted by P'.

As illustrated in FIG. 2, the soot blower 1000 according to the exemplary embodiment of the present invention serves to remove the contaminants P from the surfaces of the heat exchanger tubes T. Hereinafter, the soot blower 1000 according to the exemplary embodiment of the present invention will be described in detail with reference to FIGS. 3 to 10.

Figure 3:
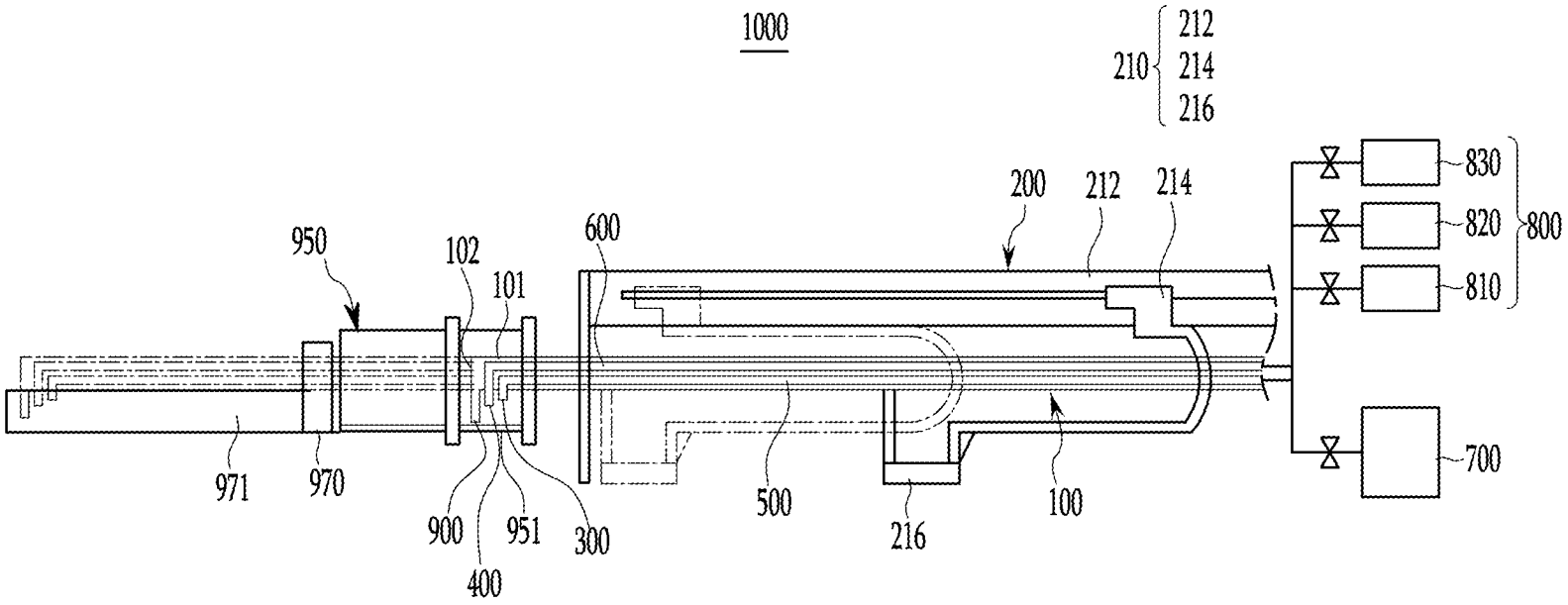
FIG. 3 is a view illustrating the soot blower according to the exemplary embodiment.

FIG. 3 is a view more clearly illustrating the soot blower 1000 illustrated in FIG. 1.

As illustrated in FIGS. 1 and 3, the number of soot blowers 1000 is one or more. The multiple soot blowers 1000 may be horizontally installed on a surface of the inlet port 11*a* of the flow path 11 of the tubular heat exchanger 10.

The soot blower 1000 includes a lance tube 100, a drive unit 200, a first nozzle 300, a second nozzle 400, a first tube 500, a second tube 600, a steam supply unit 700, a solid particle supply unit 800, a nozzle protector 900, and a nozzle maintenance chamber 950.

The lance tube 100 includes one end 101 that reciprocally moves in one direction (X) on the surface of the inlet port 11*a* of the flow path 11 of the tubular heat exchanger 10.

Here, the one direction (X) may be, but not limited to, a forward direction that intersects a movement direction of the fluid F that passes through the tubular heat exchanger 10.

Figure 4:
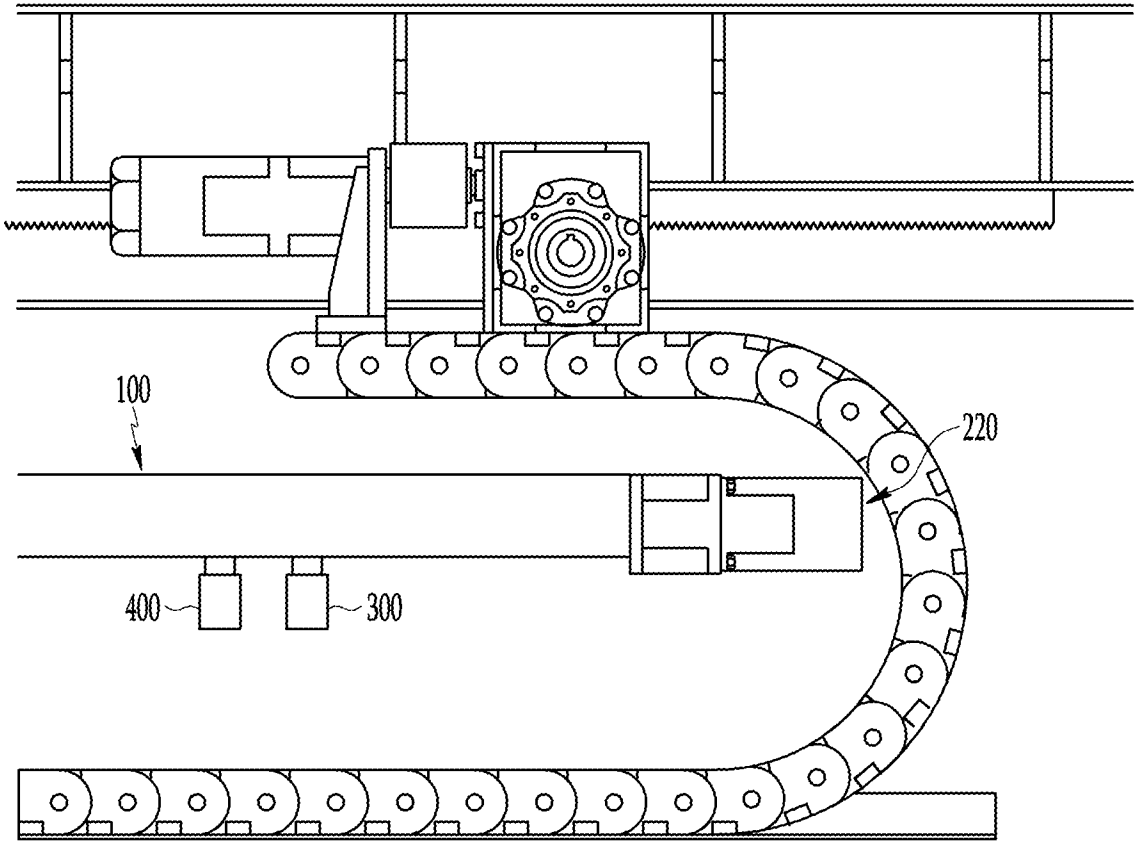
FIG. 4 is a view illustrating a drive unit that rotates a lance tube of the soot blower in FIG. 3.

FIG. 4 is a view illustrating the drive unit that rotates the lance tube of the soot blower in FIG. 3. The drive unit 200 according to the present exemplary embodiment will be described with reference to FIGS. 3 and 4.

The drive unit 200 includes a reciprocating drive unit 210 which is connected to the lance tube 100 and reciprocally moves the lance tube 100 in the one direction (X), and a rotating drive unit 220 which is connected to the lance tube 100 and rotates the lance tube 100 clockwise and counterclockwise in the one direction (X).

The lance tube 100 according to the present exemplary embodiment may be reciprocally moved in the one direction (X) by the reciprocating drive unit 210 of the drive unit 200 according to the present invention and may be rotated by the rotating drive unit 220, and as a result, it is possible to further improve the cleaning ability by increasing an area for cleaning the heat exchanger tube T. In this case, the reciprocating motion by the reciprocating drive unit 210 of the drive unit 200 and the rotational motion by the rotating drive unit 220 may be performed at the same time as described above, but the present invention is not limited thereto. A modified example is also available in which the lance tube 100 moves a predetermined distance in the one direction (X), rotates in a predetermined cycle, and then moves again in the one direction (X). This configuration may be variously modified depending on a structure of the heat exchanger 10 or a state of the contaminants P existing on the surface of the heat exchanger tube T.

In this case, the reciprocating drive unit 210 according to the present exemplary embodiment includes a sliding guide portion 212, a sliding portion 214, and a connecting portion 216. The sliding guide portion 212 is positioned on the lance tube 100 and extends in the one direction (X). The sliding portion 214 reciprocally moves in the one direction (X) along the sliding guide portion 212. At least one of the sliding portion 214 and the sliding guide portion 212 may include a driving unit such as a motor. The connecting portion 216 connects the sliding portion 214 and the lance tube 100, and the one end 101 of the lance tube 100 is reciprocally moved in the one direction (X) by the connecting portion 216 along with the reciprocating motion of the sliding portion 214.

The rotating drive unit 220 may rotate the lance tube 100 clockwise and counterclockwise. More specifically, the rotating drive unit 220 according to the present exemplary embodiment may rotate the lance tube 100 clockwise or counterclockwise within a range of more than 0° to 180° or less.

In this case, the rotating drive unit 220 according to the present exemplary embodiment may periodically change the rotation direction at a predetermined time interval. As an example, the rotating drive unit 220, which rotates the lance tube 100 clockwise for a predetermined time, may rotate the lance tube 100 counterclockwise after the elapse of the predetermined time. After the lance tube 100 is rotated counterclockwise again for the predetermined time, the lance tube 100 may be rotated clockwise again by the rotating drive unit 220 according to the present exemplary embodiment. A cleaning effect may be applied to a larger area of the tube since the rotation direction of the lance tube 100 is periodically changed at a predetermined time interval.

The first nozzle 300 is connected to the one end 101 of the lance tube 100 and discharges steam to the inlet port 11*a*. The first nozzle 300 may discharge high-temperature steam, at a steam temperature of 90° C. to 300° C. and under a pressure of 10 kg/cm$^2$ g to 50 kg/cm$^2$ g, to the surface of the inlet port 11*a*, but the present invention is not limited thereto.

The second nozzle 400 is disposed adjacent to the first nozzle 300 and connected to the one end 101 of the lance tube 100, and the second nozzle 400 discharges solid particles to the inlet port 11*a*. The second nozzle 400 may discharge solid particles including at least one of dry ice pellets, ice pellets, and sand. The second nozzle 400 may discharge the dry ice pellets, under a pressure of 0.5 kg/cm$^2$ g to 20 kg/cm$^2$ g, to the surface of the inlet port 11*a* or may discharge the ice pellets or the sand, under a pressure of 0.5 kg/cm$^2$ g to 30 kg/cm$^2$ g, to the surface of the inlet port 11*a*, but the present invention is not limited thereto.

Meanwhile, the second nozzle 400 may discharge high-pressure water to the surface of the inlet port 11*a*. The second nozzle 400 according to the present exemplary embodiment is longer than the first nozzle 300, and the solid particles, which are discharged from the second nozzle 400, may be discharged to the inlet port 11*a* under a lower pressure than the steam discharged from the first nozzle 300.

The first tube 500 penetrates the interior of the lance tube 100 and communicates with the first nozzle 300. The second tube 600 is disposed adjacent to the first tube 500, penetrates the interior of the lance tube 100, and communicates with the second nozzle 400.

The steam supply unit 700 is connected to the first tube 500 and supplies the high-temperature steam to the first tube 500.

The solid particle supply unit 800 is connected to the second tube 600 and supplies the solid particles, which include at least one of the dry ice pellets, the ice pellets, and the sand, to the second tube 600. The solid particle supply unit 800 includes multiple sub particle supply units which are a first sub particle supply unit 810, a second sub particle supply unit 820, and a third sub particle supply unit 830.

The first sub particle supply unit 810 supplies the dry ice pellets to the second tube 600, the second sub particle supply unit 820 supplies the ice pellets to the second tube 600, and the third sub particle supply unit 830 supplies the sand to the second tube 600. That is, each of the multiple sub particle supply units supplies the second tube 600 with at least one of the dry ice pellets, the ice pellets, and the sand which are solid particles different from one another.

The nozzle protector 900 is disposed adjacent to the second nozzle 400 and positioned at an outermost peripheral portion 102 of the lance tube 100, and the nozzle protector 900 is longer than the second nozzle 400. The nozzle protector 900 inhibits the first nozzle 300 and the second nozzle 400 from being damaged due to external interference when the lance tube 100 reciprocally moves in the one direction (X).

The nozzle maintenance chamber 950 is disposed adjacent to the drive unit 200 and surrounds the one end 101 of the lance tube 100. The nozzle maintenance chamber 950 is positioned within a movement route of the lance tube 100 that moves in the one direction (X).

Figure 5:
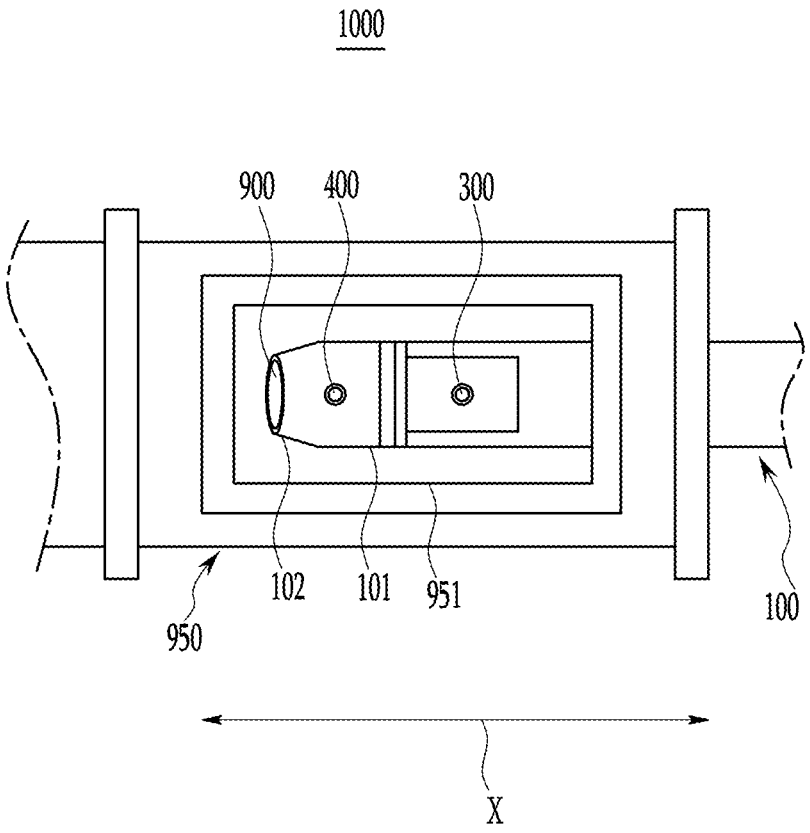
FIG. 5 is a view illustrating a bottom portion of a nozzle maintenance chamber illustrated in FIG. 3.

FIG. 5 is a view illustrating a bottom portion of the nozzle maintenance chamber illustrated in FIG. 3.

As illustrated in FIG. 5, the nozzle maintenance chamber 950 is positioned within the movement route of the lance tube 100 that moves in the one direction (X). The nozzle maintenance chamber 950 surrounds the one end 101 of the lance tube 100 and includes a gate 951 through which the first nozzle 300 and the second nozzle 400 are exposed. The first nozzle 300 and the second nozzle 400 may be replaced with nozzles having selected shapes through the gate 951.

Figure 6:
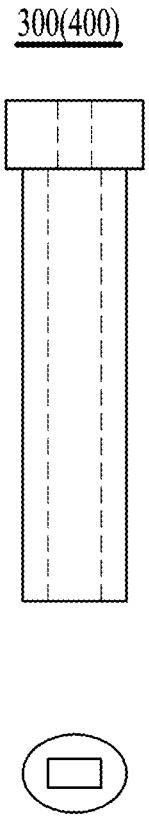
FIG. 6 is a view schematically illustrating a nozzle port of a first nozzle or a second nozzle illustrated in FIG. 3.
Figure 7:
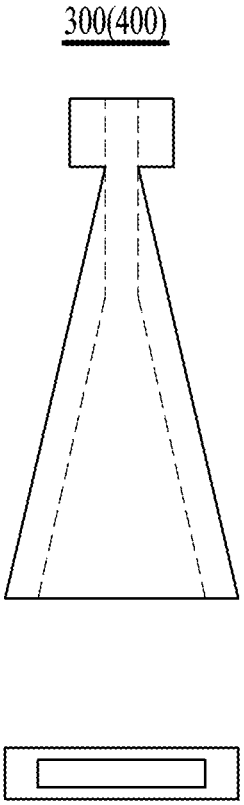
FIG. 7 is a view illustrating one modified example of FIG. 6.
Figure 8:
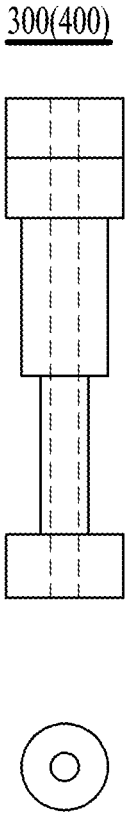
FIG. 8 is a view illustrating another modified example of FIG. 6.

FIG. 6 is a view schematically illustrating a nozzle port of the first or second nozzle illustrated in FIG. 2, FIG. 7 is a view illustrating a modified example of FIG. 6, and FIG. 8 is a view illustrating another modified example of FIG. 6. As illustrated in FIGS. 6 to 8, each of the first nozzle 300 and the second nozzle 400 may have various shapes. The second nozzle 400 may be different in shape from the first nozzle 300, but the present invention is not limited thereto.

Specifically, a discharge port of each of the first nozzle 300 and the second nozzle 400 may be quadrangular as illustrated in FIGS. 6 and 7 or circular as illustrated in FIG. 8. Other than the above-mentioned shapes, the discharge port of each of the first nozzle 300 and the second nozzle 400 may have various shapes such as an elliptical shape and a polygonal shape. The first and second nozzles 300 and 400 having shapes selected from the above-mentioned shapes may be connected to the one end 101 of the lance tube 100 through the gate 951 illustrated in FIG. 5.

As described above, the soot blower 1000 according to the exemplary embodiment includes the lance tube 100 which reciprocally moves in the one direction (X) corresponding to the tubular heat exchanger 10, the first nozzle 300 which is connected to the one end 101 of the lance tube 100 and discharges the steam, and the second nozzle 400 which is disposed adjacent to the first nozzle 300 and discharges the selected solid particles, such that the soot blower 1000 may easily clean the tubular heat exchanger 10 by selecting the steam, the dry ice pellets, the ice pellets, the sand, or the high-pressure water based on a working environment in which the tubular heat exchanger 10 is cleaned.

As an example, the principle of removing sulfuric acid ammonium salt, dust, or scattering gypsum attached to the tubular heat exchanger 10 by using the dry ice pellets will be described below. When the dry ice pellets are discharged at a high speed from the second nozzle 400 and then collide with the surface of the tubular heat exchanger 10, the dry ice pellets rapidly freeze the sulfuric acid ammonium salts attached to the tubular heat exchanger 10 to an ultralow temperature (e.g., 78° C. below zero). The frozen sulfuric acid ammonium salt is shrunk due to a peripheral temperature difference and causes many cracks. The dry ice pellets are sublimated while penetrating between the sulfuric acid ammonium salt particles through the cracks, such that a volume of the dry ice pellets expands 800 times or more, thereby raising upward only the sulfuric acid ammonium salt. The foreign substances, which are frozen to an ultralow temperature, are easily separated from the surface of the tubular heat exchanger 10 and then discharged.

Figure 9:
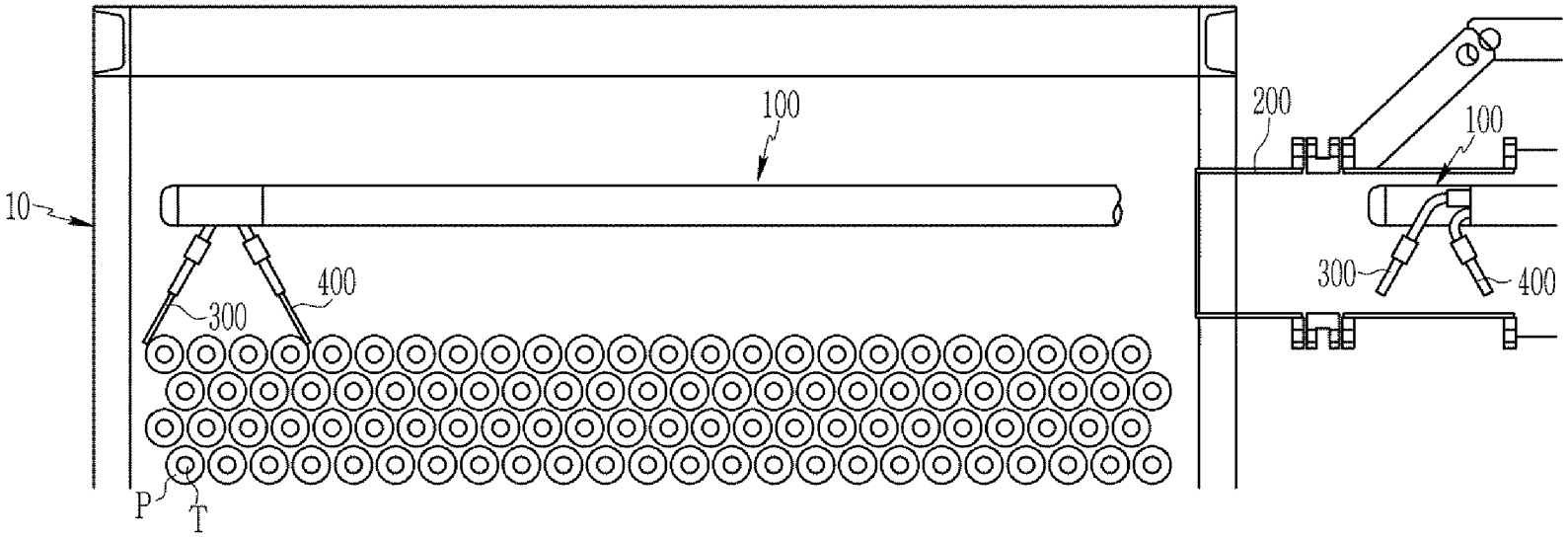
FIG. 9 is a view illustrating a soot blower according to another exemplary embodiment.
Figure 10:
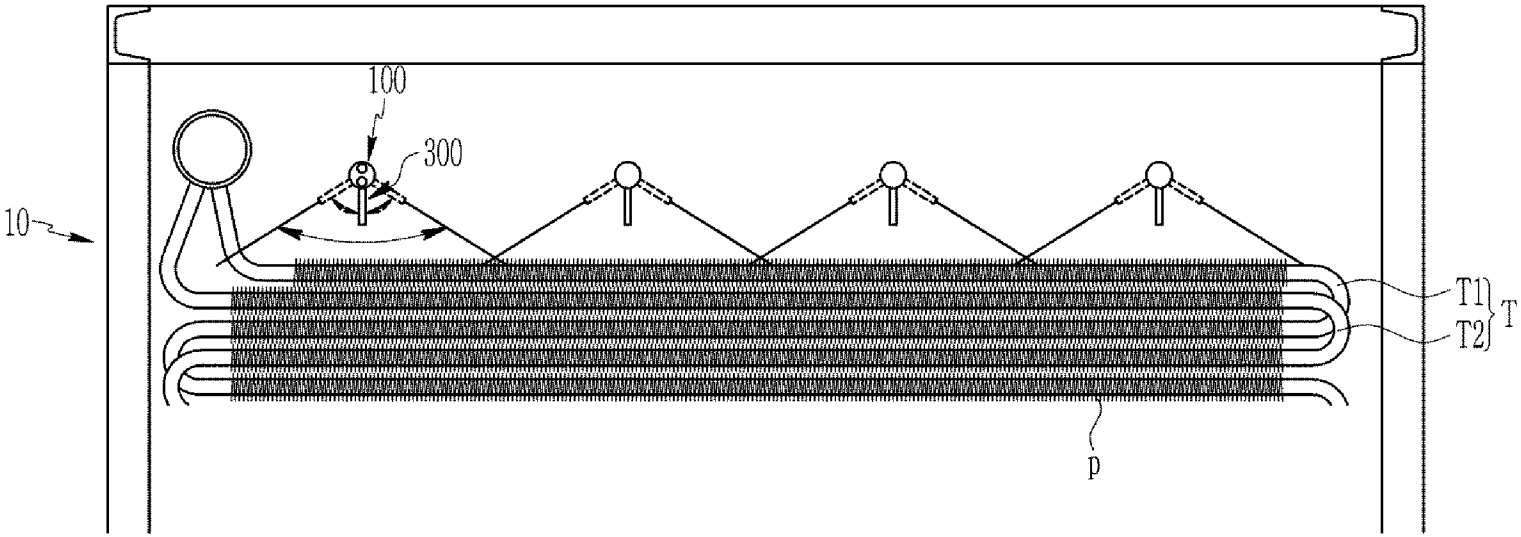
FIG. 10 is a view illustrating an operational principle of the soot blower in FIG. 9 when viewed from the front side.

Hereinafter, a soot blower according to a modified example of the present exemplary embodiment will be described with reference to FIGS. 9 and 10. FIG. 9 is a view illustrating the soot blower according to the modified example of the present exemplary embodiment. FIG. 10 is a view illustrating an operating state of the soot blower illustrated in FIG. 9 when viewed from the front side.

As illustrated in FIGS. 9 and 10, the soot blower 1000 according to the modified example of the present exemplary embodiment includes a modified first nozzle 310 and a modified second nozzle 410. The modified first and second nozzles 310 and 410 do not discharge a cleaning agent vertically but discharge the cleaning agent obliquely at a predetermined angle. More specifically, the second nozzle 410 according to the present modified example is disposed at an angle of more than 0° to 180° or less with respect to the first nozzle 310. This arrangement is made to improve the cleaning effect in the modified example in which the heat exchanger tubes T including multiple sub tubes T1 and T2 are disposed in a zigzag manner as illustrated in FIG. 9 instead of being disposed in a row as illustrated in FIG. 2.

As illustrated in FIG. 9, the first nozzle 310 and the second nozzle 410 may have the same length, but the present invention is not limited thereto. The first nozzle 310 and the second nozzle 410 may have different lengths to control a cleaning performance in accordance with the lengths.

FIG. 10 is a view illustrating an operational principle of the soot blower in FIG. 9 when viewed from the front side. FIG. 10 schematically illustrates a state in which the first nozzle 310 and the second nozzle 410 (see FIG. 9) clean the surface of the heat exchanger tube T while rotating at a predetermined inclination angle. In this case, the second nozzle 410 (see FIG. 9), which is obscured by the first nozzle 310 when viewed from the front side, is omitted in FIG. 10. An arrangement relationship between the first nozzle 310 and the second nozzle 410 will be described with reference to FIG. 9.

The first nozzle 310 is not illustrated in FIG. 10, but a rotation range of the second nozzle 410 (see FIG. 9) is illustrated. As illustrated in FIG. 10, the first nozzle 310 and the second nozzle 410 rotate clockwise or counterclockwise at a predetermined inclination angle to the left and right, and as a result, it is possible to maximally increase an area for cleaning the surface of the heat exchanger tube T. Therefore, it is possible to further improve a performance in cleaning the surface of the heat exchanger tube T. In addition to the configurations illustrated in the drawings, arrangement angles of the first and second nozzles 310 and 410 and the number of first and second nozzles 310 and 410 may be variously changed in accordance with the arrangements of the heat exchanger 10 and the heat exchanger tube T.

In this case, the cleaning agent, which is discharged through the first nozzle 310 and the second nozzle 410, may be discharged together with the high-temperature steam, the high-pressure water, the dry ice pellets, and the sand through the same nozzle at the same time as described above, and the mixtures thereof may be discharged together from the first nozzle 310 and the second nozzle 410. In addition, as described above, an exemplary embodiment is also available in which the first nozzle 310 discharges the steam and the second nozzle 410 discharges the solid particles.

Hereinafter, a method of cleaning a tubular heat exchanger according to another exemplary embodiment of the present invention will be described. The method of cleaning a tubular heat exchanger according to another exemplary embodiment of the present invention may be performed by using the soot blower 1000 that reciprocally moves and rotates in the one direction on the surface of the inlet port 11*a* of the flow path 11 of the tubular heat exchanger 10 or by using the soot blower 1000 according to the modified example.

First, the steam is discharged to the flow path 11, through which the fluid F passes, by using the soot blower 1000 that reciprocally moves and rotates in the one direction on the surface of the inlet port 11*a* of the flow path 11 of the tubular heat exchanger that performs heat exchange.

In this case, the soot blower 1000 according to the present exemplary embodiment may rotate clockwise and counterclockwise about a rotation axis disposed in a direction parallel to the one direction. As described above, the soot blower 1000 according to the present exemplary embodiment may rotate clockwise or counterclockwise within a range of more than 0° to 180° or less, and the rotation direction may be periodically changed at a predetermined time interval.

In this case, the discharging of the steam may include discharging high-temperature steam, at a steam temperature of 90° C. to 300° C. and under a pressure of 10 $kg/cm^2$ g to 50 $kg/cm^2$ g, to the surface of the inlet port.

Next, the solid particles are discharged by using the soot blower 1000 that reciprocally moves in the one direction on the surface of the inlet port 11*a*.

Specifically, the discharging of the solid particles may include discharging the dry ice pellets, under a pressure of 0.5 $kg/cm^2$ g to 20 $kg/cm^2$ g, to the surface of the inlet port, and discharging the ice pellets or sand, under a pressure of 0.5 $kg/cm^2$ g to 30 $kg/cm^2$ g, to the surface of the inlet port.

In addition, the high-pressure water may be discharged by using the soot blower 1000 that reciprocally moves in the one direction on the surface of the inlet port.

In this case, a speed of the soot blower 1000, which reciprocally moves in the one direction on the surface of the inlet port 11*a*, may vary.

In a case in which two types of cleaning solutions are simultaneously discharged from the soot blower, for example, in a case in which the high-temperature steam and the dry ice pellets are simultaneously discharged, an optimal method to improve the cleaning effect is that the high-temperature steam is first discharged to a thermal element, and then the dry ice pellets are discharged thereto. Otherwise, the cleaning effect may be decreased.

While the specific exemplary embodiments of the present invention have been described and illustrated, it is obvious to those skilled in the art that the present invention is not limited to the aforementioned exemplary embodiments, and may be variously changed and modified without departing from the spirit and the scope of the present invention. Therefore, the changed or modified examples should not be appreciated individually from the technical spirit or prospect of the present invention, and the modified examples belong to the claims of the present invention.

The invention claimed is:

1. A soot blower which includes a flow path through which a fluid passes and cleans a tubular heat exchanger positioned on the flow path, the soot blower comprising:

a lance tube which includes one end that reciprocally moves in one direction on a surface of an inlet port of the flow path;

a drive unit which is connected to the lance tube, reciprocally moves the lance tube in the one direction, and rotates the lance tube clockwise and counterclockwise; the drive unit comprising:

a reciprocating drive unit connected to the lance tube and configured to reciprocally move the lance tube in the one direction; the reciprocating drive unit comprising a sliding guide portion positioned on the lance tube and extending in the one direction; the reciprocating drive unit further comprising a sliding portion surrounding the sliding guide portion and configured to reciprocally move along the sliding guide portion; the reciprocating drive unit further comprising a connecting portion connecting the sliding portion and the lance tube;

a rotating drive unit connected to the lance tube and configured to rotate the lance tube clockwise and counterclockwise;

a first nozzle which is connected to the one end of the lance tube and discharges steam to the inlet port;

a second nozzle which is disposed adjacent to the first nozzle and connected to the one end of the lance tube and discharges solid particles to the inlet port; and a nozzle maintenance chamber which is disposed adjacent to the drive unit and surrounds the one end of the lance tube; the nozzle maintenance chamber comprising a gate through which the first nozzle and the second nozzle are exposed.

2. The soot blower of claim 1, wherein:

the rotating drive unit periodically changes a rotation direction of the lance tube.

3. The soot blower of claim 1, further comprising:

a first tube which penetrates an interior of the lance tube and communicates with the first nozzle; and a second tube which penetrates an interior of the lance tube and communicates with the second nozzle.

4. The soot blower of claim 3, further comprising:

a steam supply unit which is connected to the first tube and supplies the steam to the first tube; and a solid particle supply unit which is connected to the second tube and supplies the solid particles to the second tube.

5. The soot blower of claim 4, wherein:

the solid particle supply unit includes multiple sub particle supply units, and the multiple sub particle supply units supply different solid particles to the second tube.

6. The soot blower of claim 5, wherein:

the different solid particles include at least one of dry ice pellets, ice pellets, and sand.

7. The soot blower of claim 1, wherein:

the second nozzle is longer than the first nozzle.

8. The soot blower of claim 1, wherein:

the second nozzle is different in shape from the first nozzle.

9. The soot blower of claim 1, further comprising:

a nozzle protector which is disposed adjacent to the second nozzle, positioned at an outermost peripheral portion of the lance tube, and longer than the second nozzle.

10. The soot blower of claim 1, wherein:

the first nozzle is disposed to have an angle of more than 0° to 180° or less with respect to the second nozzle.

* * * * *